US011578595B2

(12) United States Patent
Thabit et al.

(10) Patent No.: US 11,578,595 B2
(45) Date of Patent: Feb. 14, 2023

(54) SYSTEMS AND METHODS FOR SELECTING AND PERFORMING GAS DELIVERABILITY TESTS

(71) Applicant: Saudi Arabian Oil Company, Dhahran (SA)

(72) Inventors: Khalid A. Thabit, Dhahran (SA); Adel Ali Al-Qahtani, Khobar (SA)

(73) Assignee: Saudi Arabian Oil Company, Dhahran (SA)

( * ) Notice: Subject to any disclaimer, the term of this patent is extended or adjusted under 35 U.S.C. 154(b) by 134 days.

(21) Appl. No.: 17/223,365

(22) Filed: Apr. 6, 2021

(65) Prior Publication Data

US 2022/0316332 A1 Oct. 6, 2022

(51) Int. Cl.
*E21B 49/08* (2006.01)
*E21B 47/06* (2012.01)

(52) U.S. Cl.
CPC ..... *E21B 49/0875* (2020.05); *E21B 47/06* (2013.01); *E21B 49/088* (2013.01); *E21B 2200/20* (2020.05)

(58) Field of Classification Search
CPC .... E21B 44/04; E21B 49/0875; E21B 49/087; E21B 49/088; E21B 2200/20; E21B 47/06; E21B 47/00; E21B 49/08
See application file for complete search history.

(56) References Cited

U.S. PATENT DOCUMENTS 5,337,821 A * 8/1994 Peterson ..... E21B 47/10 175/48
5,636,693 A 6/1997 Elmer
2019/0242741 A1* 8/2019 Idris ..... E21B 47/07
2019/0368916 A1* 12/2019 Al-Abdulwahed ..... E21B 47/10
2021/0062649 A1* 3/2021 Luo ..... E21B 49/082

FOREIGN PATENT DOCUMENTS

CN 10804613 A 7/2006
CN 103293562 A 9/2013
(Continued)

OTHER PUBLICATIONS

Alkinani et al., "Review of the Applications of Decision Tree Analysis in Petroleum Engineering with a Rigorous Analysis", Society of Petroleum Engineers, SPE-194795-MS, 2019.
(Continued)

*Primary Examiner* — Caroline N Butcher
(74) *Attorney, Agent, or Firm* — Dinsmore & Shohl, LLP

(57) ABSTRACT

Systems and methods for selecting and performing gas deliverability tests are disclosed. In one embodiment, a method of performing a gas deliverability test includes drilling a well, operating the well to produce gas, determining a sustainability of the well, and determining at least one of a shut-in bottom hole pressure and pressure build-up of the well and a geochemical analysis of the well. The method further includes selecting a deliverability test based at least in part on a duration of an operation of the well, a sustainability of the well, and at least one of the shut-in bottom hole pressure, the pressure build-up and the geochemical analysis of liquids of the well. The method also includes applying the deliverability test to the well.

20 Claims, 5 Drawing Sheets

(56) References Cited

FOREIGN PATENT DOCUMENTS

| | | |
|---|---|---|
| CN | 104832166 A | 8/2015 |
| CN | 104948163 A | 9/2015 |

OTHER PUBLICATIONS

Ellafi et al., "An Integrated Method for Forecasting Well Deliverability in Gas Condensate Reservoirs with Bottom Aquifer Drive", Society of Petroleum Engineers, SPE-191269-MS, 2018.
Erdogan et al., "Optimization of Decision Tree and Simulation Portfolios: A Comparison", Society of Petroleum Engineers, SPE 68575, 2001.
Hadinoto et al., "Determination of Gas Well Deliverability of Vertically Fractured Wells", Society of Petroleum Engineers of AIME, SPE 6136, 1976.
Thrasher et al., "Well Performance Analysis and Deliverability Monitoring for Layered Reservoirs without Crossflow", Society of Petroleum Engineers, SPE 29947, 1995.

* cited by examiner

SYSTEMS AND METHODS FOR SELECTING AND PERFORMING GAS DELIVERABILITY TESTS

BACKGROUND

A deliverability test is a method of testing a gas well to measure its production capabilities and certain conditions. There are different types of deliverability tests. In one type of deliverability test, a separator is used to quantify three phases flow rate based on actual measurements before proceeding with the main target to perform pressure transient analyses (PTA). In another example, a deliverability test has no separator and the main objective is to conduct a deliverability test with a focus on PTA. In this method, estimation of different phases flow rates is usually reliable.

Which deliverability test should be applied depends on attributes of the well. In some cases, an incorrect deliverability test is performed and must be redone, which causes delays and creates unnecessary costs. Further, it may be difficult to plan ahead as to how many wells will require deliverability tests. Thus, accurate planning and budgeting is adversely impacted by the lack of foreseeability with respect to deliverability testing.

SUMMARY

According to one embodiment, a method of performing a gas deliverability test includes drilling a well, operating the well to produce gas, determining a sustainability of the well, and determining at least one of a shut-in bottom hole pressure and pressure build-up of the well and a geochemical analysis of the well. The method further includes selecting a deliverability test based at least in part on a duration of an operation of the well, a sustainability of the well, and at least one of the shut-in bottom hole pressure, the pressure build-up and the geochemical analysis of liquids of the well. The method also includes applying the deliverability test to the well.

It is to be understood that both the foregoing general description and the following detailed description present embodiments that are intended to provide an overview or framework for understanding the nature and character of the claims. The accompanying drawings are included to provide a further understanding of the disclosure, and are incorporated into and constitute a part of this specification. The drawings illustrate various embodiments and together with the description serve to explain the principles and operation.

DETAILED DESCRIPTION OF THE DISCLOSURE

Embodiments of the present disclosure are directed to systems and methods for selecting and performing gas deliverability tests for gas wells. Embodiments provide an automated method to make gas deliverability test recommendations for gas wells. These recommendations may also be prioritized so that gas deliverability tests that are higher in priority may be performed before those of lower priority. More specifically, embodiments provide a new approach to assess the need to conduct gas deliverability tests as part of reservoir surveillance programs. The decisions are based on well-performance and acquired reservoir data. With the use of this approach, wells can be divided into different categories based on their type and status of production sustainability. Decisions to perform gas deliverability tests can be made after going through a decision tree. These steps include evaluation of the production sustainability, results of geochemical water analysis, and available shut-in bottom hole pressure and pressure build-up data.

Figure 1:
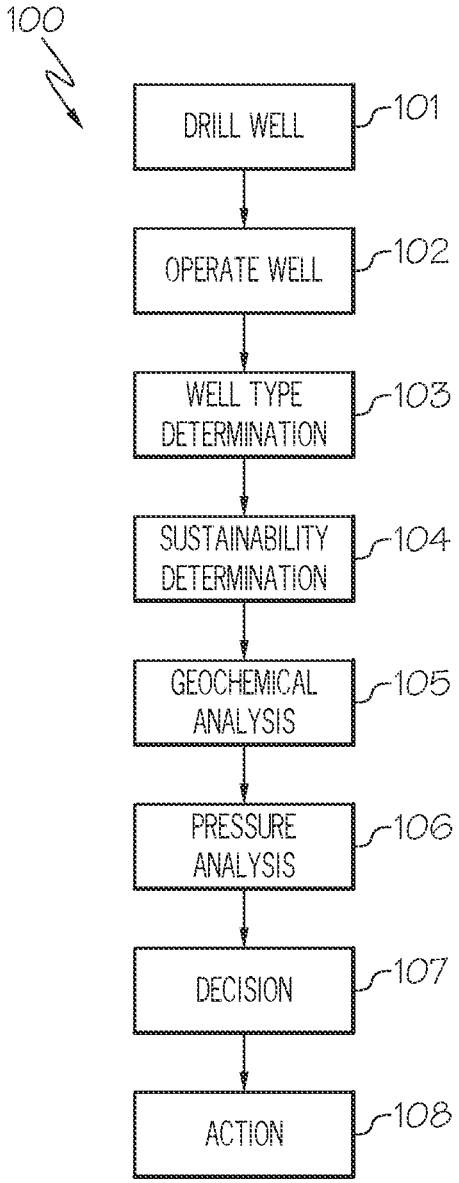
FIG. 1 illustrates a flowchart showing an example method of performing a gas deliverability test according to one or more embodiments described and illustrated herein.

Referring now to FIG. 1, a flowchart 100 illustrating an example method of performing a gas deliverability test (also referred to herein as a "deliverability test") is illustrated. It should be understood that embodiments are not limited by the method illustrated by FIG. 1, and that more or fewer steps may be performed in embodiments. At block 101, a well for extracting gas is drilled into a gas reservoir. Embodiments are not limited by the type of well that is drilled. Thus, any type of well capable of extracting hydrocarbons from a reservoir may be drilled.

At block 102, the well is operated for a period of time. During this time, the well produces gas. The period of time is not limited by this disclosure. As non-limiting examples, the period of time may be more than a week, more than a month, or more than a year.

Next, the type of well is determined at block 103. The type of well may include a new, recently stimulated well, or an old well that has been in production for a threshold amount of type (i.e., a producer well). The threshold period (s) of time that dictate whether a well is a new well or an old well is not limited by this disclosure. The well type should be identified to assess the need for deliverability tests throughout different stages of the method. Producer wells have data related to production sustainability, previous well interventions, geochemical water analysis results and reservoir data coverage. New wells which were recently stimulated go through stages related to post cleanup flowback performance, geochemical water analysis results and behavior of flowback performance from offset wells. The available data of the well impacts the type of sustainability test that should be performed. Thus, in embodiments, the type of well dictates the analyses of blocks 104-106, decision of block 107, and action of block 108.

Analyses are performed at blocks 104-106 to determine the type of sustainability test that is best for the well under evaluation. Some or all of the analyses of blocks 104-106 may be performed depending on the outcome of the analyses at blocks 104-106. Thus, one or more of blocks 104-106 may not be performed in some cases. The analyses of blocks 104-106 are described in more detail with respect to FIGS. 2A-2C.

At block 104 the sustainability of the well is determined. The test used to determine sustainability depends on whether the well is a new well or an old well.

The decision as to the appropriate deliverability test to perform in a well may be based on the well sustainability as a first stage in the overall analysis. For wells in production, wells with dropping flowing well head pressure (FWHP) at a constant gas rate may be flagged. FWHP drop can be altered for different reservoirs and different fields. Newly stimulated wells may follow the same procedure by analyzing the short period flowback performance rather than the longer period production data. Thus, sustainability impacts which type of sustainability test should be performed.

It is noted that production sustainability is directly related to production gas rate and FWHP. Both are expected to drop with time as the reservoir is depleted. However, higher rate of drop in any of these two parameters indicate unsustainable production. Sustainability can be evaluated based on real-time production data, flowback data, or deliverability tests with or without separator.

Next, the process may move to block 105 where a geochemical analysis is performed. However, it is noted that in some cases the process moves to block 106 such that a geochemical analysis is not performed, as described in more detail with respect to FIGS. 2A-2C. The geochemical analysis examines the chemical content of the liquid extracted from the well. Geochemical water analysis data can give an indication about the nature of the liquids produced with the gas. Specific water ionic composition ranges, mainly chloride, strontium and barium, may confirm production of formation water. Formation water ionic composition vary for different fields and reservoirs.

Geochemical water analyses may give a clear picture of the nature of produced water with gas. Wells with unsustainable production may be analyzed by geochemical water analyses to identify the nature of produced water in order to reach an accurate decision. Wells with unsustainable production and no signs of formation water may be tested by deliverability tests with a separator. Wells with unsustainable production and clear signs of formation water may require exploring other remedial actions. Wells with sustainable production may only need deliverability tests without a separator.

Next, the process may move to a pressure analysis at block 106. Depending on the results from block 104 and/or block 106, the pressure analysis uses one or more of shut-in bottom hole pressure (SBHP) data and pressure build-up (PBU) data of the well. Thus, available SBHP data and PBU data may be used to conclude the selection process. Embodiments may identify the available data to have an insight about wellbore accessibility status in addition to the nature of wellbore fluid. Moreover, data availability from offset wells can indicate if there is decent reservoir data coverage.

The main objective of PBU data is to have better information about the reservoir such as reservoir and fracture conductivity, skin value, and types of boundaries. PBU data provide unique reservoir parameters. However, availability of PBU data from offset wells can be reliable to drop the planned deliverability test. SBHP main objective is to measure the reservoir pressure. SBHP data can be used to identify the nature of wellbore fluid based on the calculated gradient. Wells with confirmed formation water or liquid loading issues based on SBHP can be identified to explore other remedial actions. In some cases, the pressure analysis at block 106 is not performed depending on the results of blocks 104 and 105.

At block 107, a decision is made as to which deliverability test should be applied to the well based on the previous analyses. The deliverability test may include, but is not limited to, no deliverability test, deliverability test with a separator, and deliverability test without a separator. As used herein, "no deliverability test" is a form of deliverability test. Other decisions may be made when no deliverability test is selected, such as, without limitation, providing access for a second flowback, perform remedial actions, and running a SBHP test. The deliverability test is thus based on one or more of the type of well (i.e., a new well or an old well), a sustainability of the well, a geochemical analysis of the well, and a pressure analysis of the well.

Once the decision is made at block 107, action based on the decision is performed at block 108. Thus, the deliverability test decision is effectuated on the well. For example, a sustainability test with a separator may be performed on the well. Further action based on the sustainability test may also be performed if warranted.

Figure 2A:
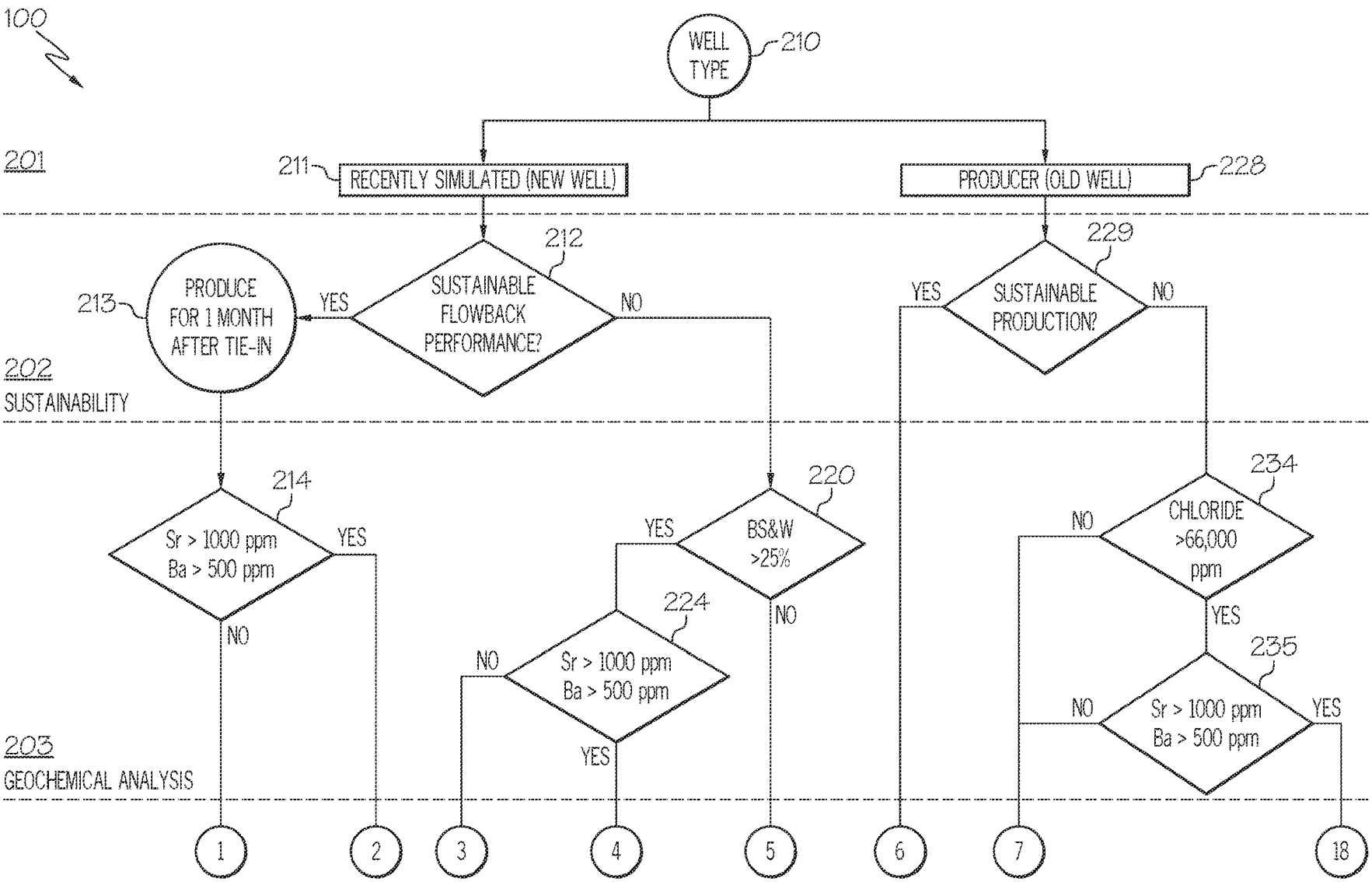
FIGS. 2A-2C illustrate a decision tree showing an example method of performing a gas deliverability test according to one or more embodiments described and illustrated herein.
Figure 2B:
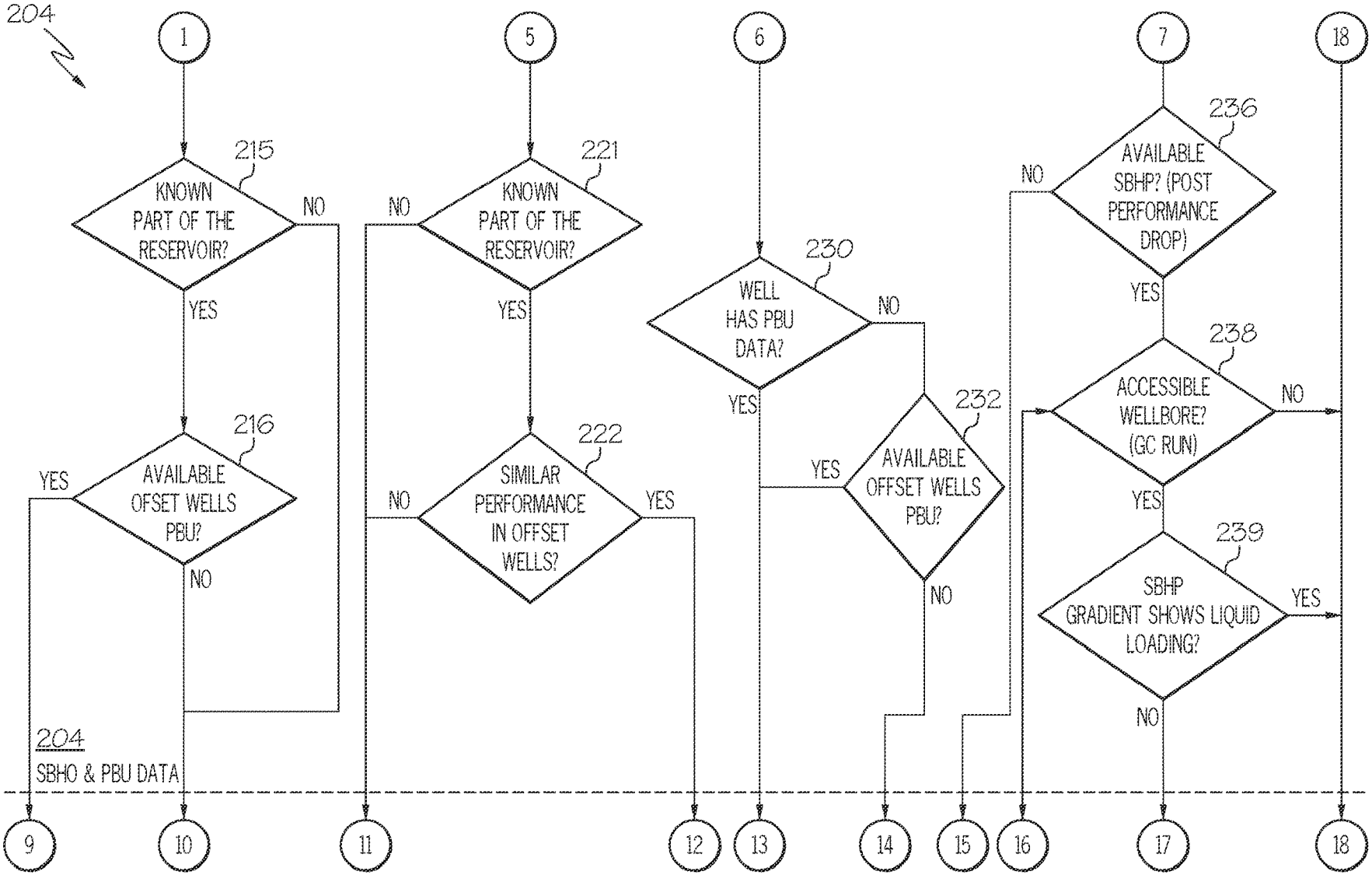
Figure 2C:
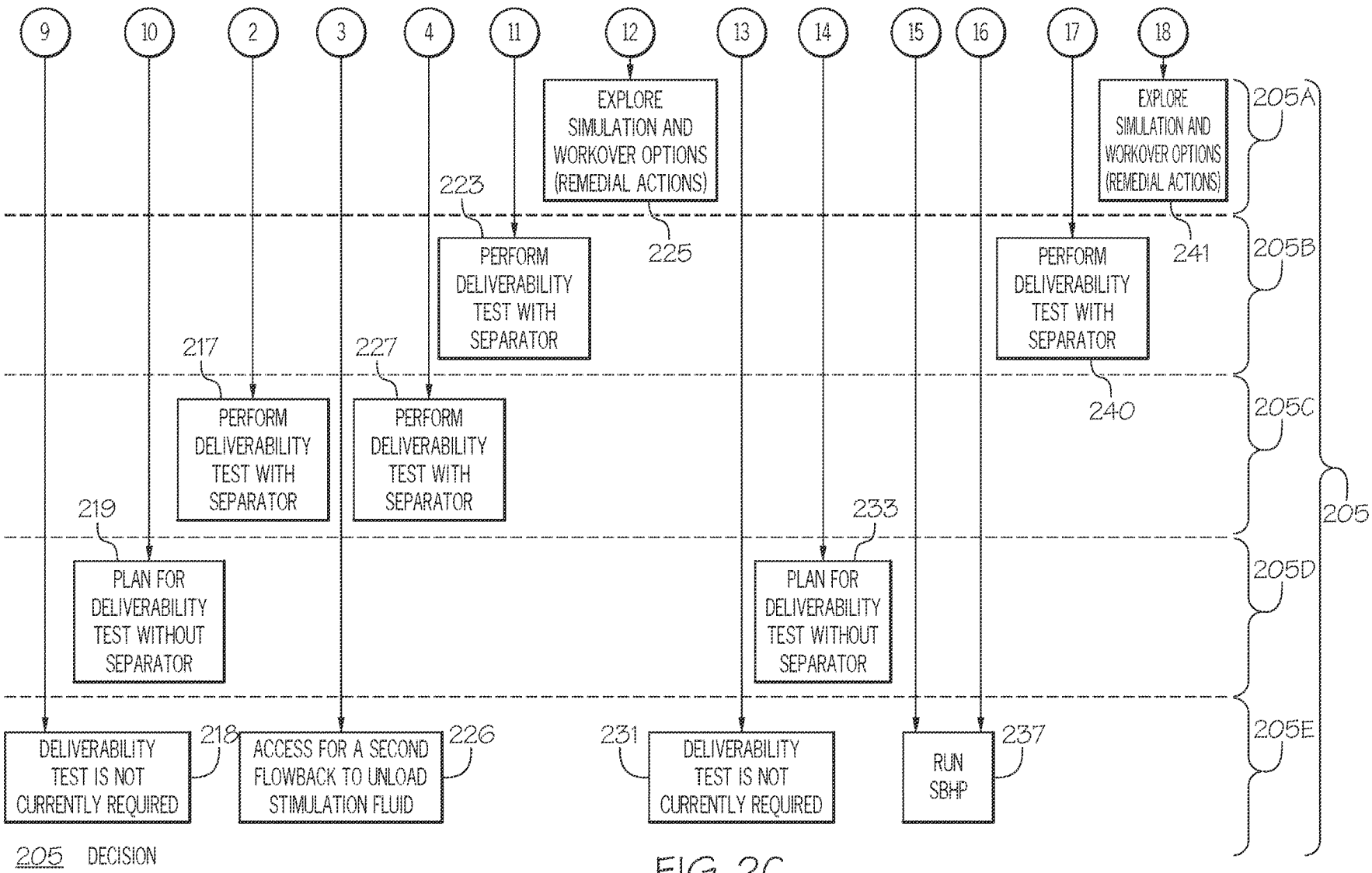

Referring now to FIGS. 2A-2C, a decision tree 200 implementing one non-limiting example of the method illustrated by the flowchart 100 of FIG. 1 is illustrated. It should be understood that more or fewer steps in the decision tree may be provided in embodiments of the present disclosure, and that embodiments are not limited to the order and number of steps shown in FIGS. 2A-2C.

At block 210, the type of well is determined in the well type determination region 201 of the decision tree 200. The type of well is based on how long the well under evaluation has been in production. In this example, there are two types of wells: a recently stimulated well (i.e., a new well) and a producer well (i.e., an old well). As a non-limiting example, a threshold time is used to classify the well as either a recently stimulated well or a producer well. A well that has been producing gas less than the threshold time may be classified as a recently stimulated well, and a well that has been producing gas longer than the threshold time may be classified as a producer well. Embodiments are not limited by a particular threshold time. As non-limiting examples, the threshold time may be a week, a month or a year.

At block 211 it is determined that the well is a recently stimulated well. In this case, the process moves to a sustainability test 202. As a first step in the sustainability test, it is determined if the well satisfies a sustainable flowback performance metric at block 212. Flowback of the well under evaluation is determined by any known or yet-to-be-developed flowback process. The main objective of the flowback is to recover the stimulation fluids pumped into the reservoir. The sustainability of a well is evaluated based on the gas rate and flowing well-head pressure behavior.

If it is determined that the well satisfies the flowback performance metric at block 212, the process moves to block 213 where the well is allowed to produce gas for one month after tie-in. Here, tie-in refers to connection of the well to the gas plant to allow for longer periods of production and clean-up and ensure well sustainability. The period of production allows the well to produce gas and water content for the subsequent geochemical analysis 203. It should be understood that embodiments are not limited to one month production, and that other time periods for production may be used.

After producing gas for a period of time at block 213, the process moves to the geochemical analysis 203, where it is determined at block 214 whether the liquid produced by the well has a strontium content greater than a strontium threshold and a barium content greater than a barium threshold. This is referred to herein as a first geochemical analysis process. At this step, liquid from the well is analyzed for strontium and barium content by any known or yet-to-be-developed process. In the example of FIG. 2A, the strontium threshold is 1000 ppm and the barium threshold is 500 ppm. However, it should be understood that other values may be applied for these thresholds.

When the strontium content is greater than the strontium threshold and the barium content is greater than the barium threshold, a deliverability test with a separator is selected as the deliverability test at block 217 at the decision region 205 of the decision tree 200. In the case of high strontium and barium content, no pressure analysis is performed.

New wells with sustainable production can be tied-in to the gas plant and put on production for a month for more clean-up. If strontium and barium are higher than thresholds, a deliverability test with separator is used to measure the water and condensate gas ratios in order to decide if the well can be produced to gas plant with no liquid handling issues. Usually, each gas plant has a limitation in terms of water handling from all wells connected to the gas plant.

It is noted that the decision region 205 of the decision tree 200 comprises five levels 205A-205E. Level 205A indicates no deliverability test and also recommends remedial actions. Level 205B indicates a first level of priority (i.e., a high level of priority), level 205C indicates a second level of priority (i.e., a middle level of priority), and level 205D indicates a third level of priority (i.e., a low level of priority). Level 205E recommends no deliverability test and may also recommend additional actions depending on the results from the analysis.

In some embodiments, the workflow generates a recommendation for a plurality of wells, such as all of the wells within a field, for example. The recommendations may be provided in a list. The list may provide all of the recommendations according to the priority levels. Thus, recommendations of a first, highest level of priority may be performed first (e.g., all recommended deliverability tests with a separator). Personnel may use this list for budgeting purposes, as well as to support logistics and supply chain management. When one or more of the strontium content is less than the strontium threshold and the barium content is less than the barium threshold at block 214, the process moves to the pressure analysis where it is determined whether or not the well is in a known part of the reservoir in which it was drilled at block 215. A known part of a reservoir is identified based on the availability of offset wells with enough and sufficient data. Sometimes, wells are drilled targeting a specific reservoir with no offset wells. Therefore, more information will be required in order to reach to a better decision on the way forward for that well. As used herein "known part of a reservoir" means there is at least one offset well having PBU data. If the well is not within a known part of the reservoir, a deliverability test without a separator is selected at block 219 as a deliverability test at the decision region 205 of the decision tree 200 to have PBU analyses performed. Block 215 or blocks 215 and 216 define a first pressure measurement process.

If the well is within a known part of the reservoir, it is determined whether or not there are offset wells having PBU data. When there is PBU data available from offset wells, a deliverability test is not currently required and thus no deliverability test is selected as the deliverability test at block 217 in the decision region 205 of the decision tree 200. When there is no available PBU data from offset wells, a deliverability test without a separator is selected as the deliverability test at block 219 of the decision region 205 of the decision tree 200.

Referring once again to the sustainability analysis 202 at block 212, when the well does not satisfy the sustainable flowback performance metric, the process moves to block 220 of the geochemical analysis 203. Block 220 or blocks 220 and 224 define a second geochemical analysis process separate from the first geochemical analysis process defined by block 214 and described above. At block 220, it is determined whether the liquids produced by the well satisfy a basic sediment and water metric. The basic sediment and water metric may be threshold. Embodiments are not limited by the value of the threshold for the basic sediment and water metric. As a non-limiting example, the threshold for the basic sediment and water metric may be 25%. When the basic sediment and water threshold is not satisfied at block 220, the process moves to a second pressure measurement process of the pressure analysis process 204.

The second pressure measurement process is defined by block 221 or blocks 221 and 222. At block 221 it is determined whether or not the well is within a known part of the reservoir. If the well is not in a known part of the reservoir, a deliverability test with a separator is selected as the deliverability test at block 223 of the decision region 205 of the decision tree 200. If the well is in a known part of the reservoir at block 221, the process moves to block 222 where it is determined if the well has a similar performance as offset wells within the reservoir. Well performance can be correlated and compared to multiple offset wells using gas rate and FWHP trends. If the well does not have similar performance as offset wells, a deliverability test with a separator is selected as the deliverability test at block 223 of the decision region 205 of the decision tree 200. Wells drilled in known reservoir areas yet showing different performance comparing to offset wells should be tested by a deliverability test with separator in order to get more information to have a better decision on the way forward.

If the well has a similar performance as offset wells within the reservoir, no deliverability test is selected as the deliverability test at block 225 of the decision region 205 of the decision tree 200. Additionally at block 225, the system recommends remedial actions in the form of simulation and workover options. Non-limiting examples of stimulation and workover options include:

Nitrogen lifting in case of liquid loading
Fracturing and re-fracturing
Targeting other reservoirs
Sidetracking the well targeting the same reservoir
Sidetracking the well targeting different reservoir.

Referring once again to the well type determination region 201 of the decision tree 200, at block 228 it is determined that the well is a producer well (i.e., an old well) as it has been in production for longer than the threshold time. At block 229, it is determined whether or not the well has sustainable production. That is, it is determined whether or not the well satisfies a sustainable production metric at block 229. Thus, the production of the well is measured and compared against the sustainable production metric. The sustainable production metric may be a production threshold. Embodiments are not limited by any production threshold. As a non-limiting example, the production threshold may be related to flowing well-head pressure decline at constant gas rate.

If the production of the well satisfies the sustainable production metric (e.g., if the production is above a production threshold), the process skips the geochemical analysis 203 and moves to a third pressure measurement process of the pressure analysis process 204. The geochemical analysis 203 is skipped in this instance because sustainable gas production is not usually associated with major formation water production. The third pressure measurement process may include block 230 or blocks 230 and 232. At block 230 it is determined whether or not the well has PBU data available. If the well does have PBU data available, no deliverability test is selected as the deliverability test at block 231 at the decision region 205 of the decision tree 200.

If the well does not have PBU data available, the process moves to block 232 where it is determined whether or not there is PBU data available for offset wells. If there is PBU data available for offset wells, no deliverability test is selected as the deliverability test at block 231 at the decision region 205 of the decision tree 200. If the well does not have PBU data available for offset wells, a deliverability test without a separator is chosen as the deliverability test at block 233 at the decision region 205 of the decision tree 200.

Referring once again to block 229 of the sustainability analysis 202 of the decision tree 200, if it determined that the production of the well does not satisfy the sustainable production metric (e.g., if the production is below a production threshold), the process moves to a third geochemical analysis defined by block 234 or blocks 234 and 235. At block 234 it is determined whether the liquid produced by the well has a chloride content greater than a chloride threshold. High chloride is the first indication of formation water production.

At this step, liquid from the well is extracted and analyzed by any known or yet-to-be-developed process for chloride content. In the example of FIG. 2A, the chloride threshold is 66,000 ppm. However, it should be understood that other values may be utilized for this threshold.

If the chloride content of the liquid produced by the well is less than the chloride threshold, the process moves to a fourth pressure measurement process of the pressure analysis process 204. The fourth pressure measurement process may be defined by block 236, blocks 236 and 238 or blocks 236, 238 and 239. At block 236 it is determined whether or not the well has SBHP data available. If there is no SBHP data available, the process moves to block 237 of the decision region 205, which recommends running a SBHP test to obtain the SBHP for the well. The process then moves to block 238. If there is SBHP data available at block 236, the process moves to block 238.

At block 238, it is determined whether or not the wellbore is accessible. Usually, in any rigless intervention, a gauge cutter (GC) is run with slickline in order to ensure the wellbore is accessible with no obstructions. If it is determined that the wellbore is not accessible, the process moves to block 241 of the decision region 205 of the decision tree 200. At block 241, it is recommended that remedial actions are taken, such as exploring simulation and workover options.

Non-limiting examples stimulation and workover options include:

Nitrogen lifting in case of liquid loading
Fracturing and re-fracturing
Targeting other reservoirs
Sidetracking the well targeting the same reservoir
Sidetracking the well targeting different reservoir.

If the wellbore is accessible at block 238, the process moves to block 239 where it is determined whether the SBHP data indicates liquid loading. If the SBHP data does not show liquid loading at block 239, a deliverability test with a separator is selected as the deliverability test at block 240 of the decision region 205 of the decision tree 200. If the SBHP data shows liquid loading at block 239, no deliverability test is selected as the deliverability test at block 241 of the decision region 205 of the decision tree 200. Further at block 241, it is recommended that remedial action be taken such as exploring simulation and workover options.

Returning to block 238, if the wellbore is not accessible, no deliverability test is selected as the deliverability test at block 241 of the decision region 205 of the decision tree. Further, it is recommended that remedial action be taken such as exploring simulation and workover options because inaccessible wellbores may require either rig or rigless interventions in order to clear the obstruction inside the wellbore.

Returning to block 234, if the chloride content of the liquid produced by the well is greater than the chloride threshold, the process moves to block 235. At block 235 it is determined whether the liquid produced by the well has a strontium content greater than a strontium threshold and a barium content greater than a barium threshold. At this step, liquid from the well is analyzed by any known or yet-to-be-developed process for strontium and barium content. In the example of FIG. 2A, the strontium threshold is 1000 ppm and the barium threshold is 500 ppm. However, it should be understood that other values may be applied for these thresholds.

When the strontium content is more than the strontium threshold and the barium content is greater than the barium threshold, no deliverability test is selected as the deliverability test at block 241 of the decision region 205 of the decision tree 200. At block 241, it is recommended that remedial actions are taken, such as exploring simulation and workover options. When one or more of the strontium content is less than the strontium threshold and the barium content is less than the barium threshold at block 235, the process moves to block 236 and is completed as described above.

Upon receiving a recommendation, the deliverability test or recommended remedial action is physically carried out on the well under evaluation. The deliverability recommendation saves time and cost because the correct deliverability test method is performed the first time, and deliverability tests that are not needed are prevented from being performed. The automated process is performed, and the recommendations can be automatically presented to the user, such as in a graphical user interface, messaging system, or any means for machine-human communication.

Figure 3:
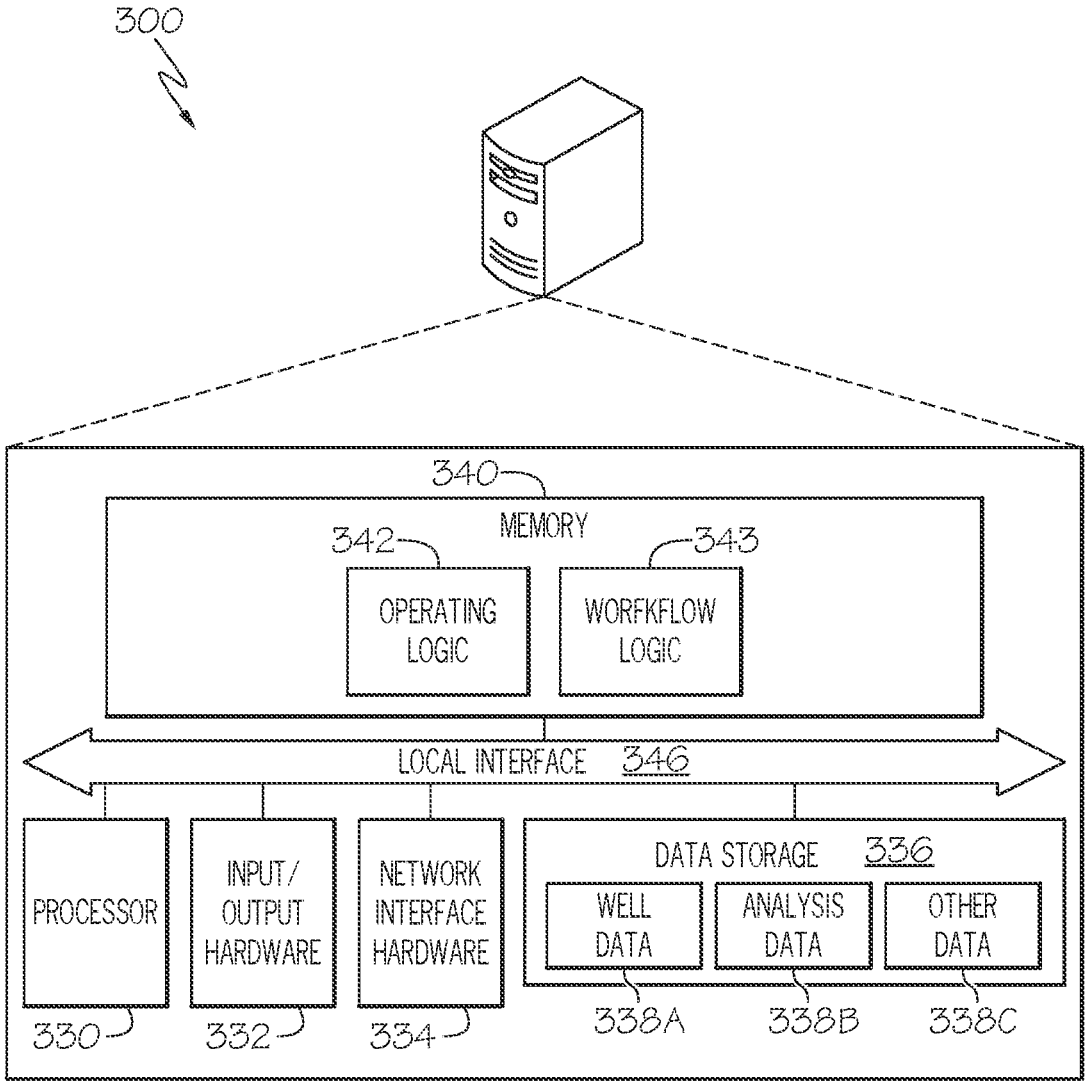
FIG. 3 schematically illustrates an example computing device for selecting and performing a gas deliverability test according to one or more embodiments described and illustrated herein.

Embodiments of the present disclosure may be implemented by a computing device, and may be embodied as computer-readable instructions stored on a non-transitory memory device. FIG. 3 depicts an example computing device 300 configured to perform the functionalities described herein. The example computing device 300 provides a system for performing a gas deliverability test, and/or a non-transitory computer usable medium having computer readable program code for performing a gas deliverability test embodied as hardware, software, and/or firmware, according to embodiments shown and described herein. While in some embodiments, the computing device 300 may be configured as a general purpose computer with the requisite hardware, software, and/or firmware, in some embodiments, the computing device 300 may be configured as a special purpose computer designed specifically for performing the functionality described herein. It should be understood that the software, hardware, and/or firmware components depicted in FIG. 3 may also be provided in other computing devices external to the computing device 300 (e.g., data storage devices, remote server computing devices, and the like).

As also illustrated in FIG. 3, the computing device 300 (or other additional computing devices) may include a processor 330, input/output hardware 332, network interface hardware 334, a data storage component 336 (which may include well data 338A, analysis data 338B, any other data 338C for performing the functionalities described herein), and a non-transitory memory component 340. The memory component 340 may be configured as volatile and/or nonvolatile computer readable medium and, as such, may include random access memory (including SRAM, DRAM, and/or other types of random access memory), flash memory, registers, compact discs (CD), digital versatile discs (DVD), and/or other types of storage components. Additionally, the memory component 340 may be configured to store operating logic 342 and workflow logic 343 for selecting and performing gas deliverability tests as described herein (each of which may be embodied as computer readable program code, firmware, or hardware, as an example). A local interface 346 is also included in FIG. 3 and may be implemented as a bus or other interface to facilitate communication among the components of the computing device 300.

The processor 330 may include any processing component configured to receive and execute computer readable code instructions (such as from the data storage component 336 and/or memory component 340). The input/output hardware 332 may include a graphics display device, keyboard, mouse, printer, camera, microphone, speaker, touch-screen, and/or other device for receiving, sending, and/or presenting data. The network interface hardware 334 may include any wired or wireless networking hardware, such as a modem, LAN port, wireless fidelity (Wi-Fi) card, WiMax card, mobile communications hardware, and/or other hardware for communicating with other networks and/or devices, such as to receive the data from various sources, for example.

It should be understood that the data storage component 336 may reside local to and/or remote from the computing device 300, and may be configured to store one or more pieces of data for access by the computing device 300 and/or other components. As illustrated in FIG. 3, the data storage component 336 may include well data 338A, which in at least one embodiment includes data with respect to one or more wells, such as pressure data, geochemical data, location data, operational data, and the like. The well data 338A may be stored in one or more data storage devices. Similarly, analysis data 338B may be stored by the data storage component 336 and may include information relating to evaluating the well data, such as metrics and thresholds (e.g., sustainable production metric, time threshold, strontium threshold, and the like). Other data to perform the functionalities described herein may also be stored in the data storage component 338. In some embodiments, the computing device 300 may be coupled to a remote server or other data storage device that stores the relevant data.

Included in the memory component 340 may be the operating logic 342 and the workflow logic 343. The operating logic 342 may include an operating system and/or other software for managing components of the computing device 300. The operating logic 342 may also include computer readable program code for displaying the graphical user interface used by the user to input parameters and review results of the simulations. The workflow logic 343 may reside in the memory component 340 and may be configured to facilitate the functionalities described herein. For example, the workflow logic 343 may be configured to execute at least portions of the process of FIG. 1 and the decision tree 200 of FIGS. 2A-2C.

The components illustrated in FIG. 3 are merely exemplary and are not intended to limit the scope of this disclosure. More specifically, while the components in FIG. 3 are illustrated as residing within the computing device 300, this is a non-limiting example. In some embodiments, one or more of the components may reside external to the computing device 300.

It should now be understood that embodiments of the present disclosure are directed to systems and methods for selecting and performing a gas deliverability test. The embodiments described herein use well data to automatically make a gas deliverability test recommendation. This recommendation is then physically performed on the well. Thus, embodiments identify and prioritize the need for deliverability tests for gas wells. The methodologies of the present disclosure reduces the subjectivity of well selection and simultaneously integrates engineering decisions and processes to provide a firm candidates list in timely manner.

Embodiments reduce planning time and minimize development risks. A prioritized list of deliverability tests is generated, which improves the budgeting process and improves logistics and supply chain management as personnel are able to receive and review the list of future deliverability tests and plan accordingly.

Having described the subject matter of the present disclosure in detail and by reference to specific embodiments thereof, it is noted that the various details disclosed herein should not be taken to imply that these details relate to elements that are essential components of the various embodiments described herein, even in cases where a particular element is illustrated in each of the drawings that accompany the present description. Further, it will be apparent that modifications and variations are possible without departing from the scope of the present disclosure, including, but not limited to, embodiments defined in the appended claims. More specifically, although some aspects of the present disclosure are identified herein as preferred or particularly advantageous, it is contemplated that the present disclosure is not necessarily limited to these aspects.

What is claimed is:

1. A method of performing a deliverability test, the method comprising:

operating a well to produce gas;

determining a sustainability of the well;

determining at least one of a shut-in bottom hole pressure and pressure build-up of the well, and performing a geochemical analysis of liquids produced by the well;

selecting a deliverability test based at least in part on a duration of an operation of the well, a sustainability of the well, and at least one of the shut-in bottom hole pressure, the pressure build-up and the geochemical analysis; and applying the deliverability test to the well.

2. The method of claim 1, wherein the deliverability test is one of a deliverability test with a separator, a deliverability test without a separator, and no deliverability test.

3. The method of claim 1, further comprising performing the geochemical analysis of liquids produced by the well.

4. The method of claim 3, wherein:

when the well has been in production for more than a threshold time, performing the geochemical analysis of liquids comprises a geochemical analysis process; and when the well has been in production for less than the threshold time, performing the geochemical analysis of liquids comprises another geochemical analysis process that is different from the geochemical analysis process.

5. The method of claim 3, wherein the geochemical analysis of liquids comprises measuring for one or more of strontium, barium, chloride and basic sediment and water.

6. The method of claim 1, wherein:

when the well has been in production for less than a threshold time, determining the sustainability of the well comprises determining whether the well satisfies a sustainable flowback performance metric;

when the well satisfies the sustainable flowback performance metric, the method further comprises:

producing gas from the well for a period of time after a tie-in; and performing a first geochemical analysis process of liquids produced within the gas; and when the well does not satisfy the sustainable flowback performance metric, the method further comprises performing a second geochemical analysis process.

7. The method of claim 6, wherein:

the first geochemical analysis process comprises determining whether liquids produced by the well have a strontium content greater than a strontium threshold and the liquids have a barium content greater than a barium threshold;

when the strontium content is greater than the strontium threshold and the barium content is greater than the barium threshold, a deliverability test with a separator is selected as the deliverability test; and when at least one of the strontium content is less than the strontium threshold and the barium content is less than the barium threshold, the method further comprises performing a first pressure measurement process.

8. The method of claim 7, wherein the first pressure measurement process comprises:

determining whether the well is in a known part of a reservoir;

when the well is not in a known part of a reservoir, a deliverability test without a separator is selected as the deliverability test;

when the well is in a known part of a reservoir, the first pressure measurement process further comprises:

determining whether pressure build-up data is available from offset wells;

when there is no pressure build-up data available from offset wells, a deliverability test without a separator is selected as the deliverability test; and when there is pressure build-up data available from offset wells, no deliverability test is selected as the deliverability test.

9. The method of claim 6, wherein:

the second geochemical analysis process comprises determining whether liquids produced by the well satisfy a basic sediment and water metric;

when the liquids do not satisfy the basic sediment and water metric, performing a second pressure measurement process;

when the liquids satisfy the basic sediment and water metric, the second geochemical analysis process further comprises determining whether the liquids have a strontium content greater than a strontium threshold and the liquids have a barium content greater than a barium threshold;

when the strontium content is greater than the strontium threshold and the barium content is greater than the barium threshold, a deliverability test with a separator is selected as the deliverability test; and when at least one of the strontium content is less than the strontium threshold and the barium content is less than the barium threshold, no deliverability test is selected as the deliverability test and the method further comprises providing an access in the well for a second flowback to unload simulation fluid.

10. The method of claim 9, wherein the second pressure measurement process comprises:

determining whether the well is in a known part of a reservoir;

when the well is not in a known part of a reservoir, a deliverability test with a separator is selected as the deliverability test;

when the well is in a known part of a reservoir, the second pressure measurement process further comprises:

determining whether the well has a similar performance as offset wells;

when the well does not have a similar performance as offset wells, a deliverability test with a separator is selected as the deliverability test; and when the well does have a similar performance as offset wells, no deliverability test is selected as the deliverability test.

11. The method of claim 1, wherein:

when the well has been in production for greater than a threshold time, determining the sustainability of the well comprises determining whether the well satisfies a sustainable production metric;

when the well satisfies the sustainable production metric, the method further comprises performing a third pressure measurement process; and when the well does not satisfy the sustainable production metric, the method further comprises performing a third geochemical analysis process.

12. The method of claim 11, wherein the third pressure measurement process comprises:

when there exists pressure build-up data for the well, no deliverability test is selected as the deliverability test;

when there is no pressure build-up data for the well, the third pressure measurement process further comprises:

when there is available pressure build-up data for offset wells, no deliverability test is selected as the deliverability test; and when there is no pressure build-up data for offset wells, a deliverability test without a separator is selected as the deliverability test.

13. The method of claim 11, wherein the third geochemical analysis process comprises:

measuring liquids of the well for one or more of strontium, barium, and chloride;

when at least one of strontium is less than a strontium threshold, barium is less than a barium threshold, and chloride is less than a chloride threshold, the method further comprises performing a fourth pressure measurement process;

when chloride is greater than the chloride threshold, and at least one of strontium is less than the strontium threshold and barium is less than the barium threshold, the method further comprises performing the fourth pressure measurement process; and when chloride is greater than the chloride threshold, strontium is greater than the strontium threshold and barium is greater than the barium threshold, the method further comprises performing a fifth pressure measurement process.

14. The method of claim 13, wherein:

the fourth pressure measurement process comprises receiving shut-in bottom hole pressure data for the well and determining if a wellbore of the well is accessible (GC run);

when the wellbore of the well is not accessible, no deliverability test is selected as the deliverability test; and when the wellbore of the well is accessible, the fourth pressure measurement process further comprises determining whether the shut-in bottom hole pressure data indicates liquid loading such that:

when the shut-in bottom hole pressure data indicates liquid loading, no deliverability test is selected as the deliverability test; and when the shut-in bottom hole pressure data does not indicate liquid loading, a deliverability test without a separator is selected as the deliverability test.

15. The method of claim 13, wherein:

the fifth pressure measurement process comprises receiving shut-in bottom hole pressure data for the well;

when the shut-in bottom hole pressure data indicates liquid loading, no deliverability test is selected as the deliverability test; and when the shut-in bottom hole pressure data does not indicate liquid loading, a deliverability test without a separator is selected as the deliverability test.

16. The method of claim 1, wherein a deliverability test with a separator is selected as the deliverability test when the well has been in production for less than a threshold time, strontium of liquids produced by the well is greater than a strontium threshold and barium of the liquids is greater than a barium threshold.

17. The method of claim 1, wherein a deliverability test with a separator is selected as the deliverability test when the well has been in production for less than a threshold time, basic sediment and water of liquids produced by the well is greater than 25%, and at least one of the well is not part of a known reservoir and a performance of the well is not similar to offset wells.

18. The method of claim 1, wherein a deliverability test without a separator is selected as the deliverability test when the well has been in production for longer than a threshold time, there is no pressure build-up data for the well, and pressure build-up data for offset wells are not available.

19. The method of claim 1, wherein no deliverability test is selected as the deliverability test then the well has been in production for less than a threshold time, at least one of strontium of liquids produced by the well is less than a strontium threshold and barium of liquids is less than a barium threshold, and pressure build-up data for offset wells are not available.

20. The method of claim 1, wherein a deliverability test with a separator is selected as the deliverability test when the well has been in production for longer than a threshold time, a production of the well is sustainable, pressure build-up data for the well is not available, and pressure-build up data for offset wells are not available.

* * * * *